US005826504A

United States Patent [19]

Elmassian

[11] Patent Number: 5,826,504

[45] Date of Patent: Oct. 27, 1998

[54] METHOD OF MAKING A PRECIOUS METAL PENDANT RESEMBLING A LICENSE PLATE AND A PRODUCT BY THAT PROCESS

[76] Inventor: Dikran Elmassian, P.O. Box 5001, 720 Forest Green Dr., Manrovia, Calif. 91017-5001

[21] Appl. No.: 833,493

[22] Filed: Apr. 7, 1997

[51] Int. Cl.[6] ..... A44C 27/00

[52] U.S. Cl. ..... 101/32; 29/896.4; 101/423

[58] Field of Search ..... 29/896.4, 896.41, 29/896.411, 896.412, 896.43; 101/32, 483

[56] References Cited

U.S. PATENT DOCUMENTS

| | | | |
|---|---|---|---|
| 958,641 | 5/1910 | Heeren | 29/896.41 |
| 1,821,577 | 9/1931 | Povalski | 29/896.4 |
| 1,850,856 | 3/1932 | Weindel, Jr. | 101/32 |
| 3,824,921 | 7/1974 | Alexander | 101/19 |
| 3,898,925 | 8/1975 | Alexander | 101/18 |
| 3,901,143 | 8/1975 | Alexander et al. | 101/18 |
| 3,987,721 | 10/1976 | Alexander et al. | 101/18 |
| 4,339,994 | 7/1982 | Crasnianski et al. | 101/4 |
| 4,611,483 | 9/1986 | Hadaway | 72/453.02 |
| 4,742,704 | 5/1988 | Wellington et al. | 72/57 |
| 5,029,053 | 7/1991 | Solow | 362/83.2 |
| 5,526,668 | 6/1996 | Futamura et al. | 72/324 |
| 5,611,144 | 3/1997 | Gusky | 29/896.411 |
| 5,655,300 | 8/1997 | Gruppach | 29/896.411 |

*Primary Examiner*—John S. Hilten
*Assistant Examiner*—Leslie Grohusky
*Attorney, Agent, or Firm*—Stephen E. Feldman

[57] ABSTRACT

The instant invention provides a process and a product made by the process. The first step of the process includes: providing a press having at least one die which forms the negative image of one face of a license plate of sufficiently small size to be used as an element of jewelry. The second step of the process includes: providing a generally planar blank having an upper and a lower surface, and is comprised of a precious metal such as: gold, silver, platinum, palladium, vanadium or combinations of these metals. The third step of the process includes: impressing the at least one die on the blank with the press sufficient to emboss a positive image of the license plate on at least one surface. The press of the invention also comprises at least one other die which forms the negative image of the face opposite the one face of the license plate and is positioned in the press opposite to the at least one die, sufficient to produce at least one copy of the license plate when the at least one die is caused to be pressed against the at least one other die within the press. The product by the process comprises the finished element formed in the image of a miniature license plate, which has use as jewelry.

7 Claims, 2 Drawing Sheets

METHOD OF MAKING A PRECIOUS METAL PENDANT RESEMBLING A LICENSE PLATE AND A PRODUCT BY THAT PROCESS

BACKGROUND OF THE INVENTION

The instant invention (hereinafter "the invention") broadly relates to a method of manufacturing jewelry components by a pressure press process and a product manufactured by the method. More specifically the invention relates to a method of manufacturing a necklace pendant, or the like, and the product of the process. Still more specifically, the invention relates to a method of manufacturing a necklace pendant, or the like, made in the form of a vehicular license plate, and the product of the process.

There are many prior art inventions which disclose variously modified presses and their particularized uses:

U.S. Pat. No. 4,742,704 to Wellington, et al teaches a highly compact, bench mounted, fast cycle, high tonnage and soft punch type of hydraulic press designed to form thin metal blanks into a wide variety of artifacts such as jewelry. The under surface of the piston incorporates a counterbore containing a resilient urethane forming pad which, under very great pressure applied by the piston, imparts very fine detail, laterally as well as vertically, to the blank being formed into or over the die as the counterbore tightly envelopes the die. A rapid manually operated die shuttling device which provides for one die to be un-loaded and loaded as the blank of the other die is being pressed, and a rapid manually operated hydraulic valve actuating device, in combination with the piston's very short pressing stroke, effect a fast and safe operating cycle.

U.S. Pat. No. 3,898,925 to Alexander teaches a die for use in a power press to produce automobile license plates or the like which includes a flat concentric assembly of relatively rotatable rings each of which has a circular series of consecutive digit embossing elements at the obverse side of the assembly. At the converse side of the ring assembly a back and forth swingable indexing arm cooperates with notches in the rings so as to rotate the rings stepwise in predetermined order and present the digit embossing elements thereof in successive serial number configurations.

U.S. Pat. No. 3,987,721 to Alexander, et al teaches an apparatus for manufacturing discrete embossed consecutively numbered license plates from a continuous length of web or strip of sheet metal comprises a hole punching press, an embossing press, a rimming press, and a blanking press, all of which operate in unison. A feed conveyor is located between the rimming and blanking presses to advance the web in steps through the entire series of presses. The movable platen of the embossing press cooperates with a numerical registering device having an assembly of relatively rotatable decimal rings and each ring has a series of embossed numbers on its obverse side and a corresponding number of holes on its converse side. The registering device also comprises an indexing mechanism to advance the rings in desired sequences and the indexing mechanism comprises a motor driven oscillatory indexing arm movable through a counting stroke to advance one or more rings one step and a return stroke. The indexing arm carries four pneumatically actuated clutch units, each having a clutch pin selectively extendable to engage the pin hole on its associated ring to advance that ring. The indexing mechanism further comprises four stationarily mounted pneumatically actuated lock pin units, each having a lock pin selectively extendable to engage the pin hole on its associated ring to lock the ring until the next advance is required. Appropriate control means are provided.

U.S. Pat. No. 4,339,994 to Crasnianski teaches a machine for automatically stamping license plates, in particular for automotive vehicles, comprising a motor and a flywheel solidly joined to the machine frame for the purpose of activating a stamping system with punch and die using a clutch system. The clutch system is a non-slipping rotary system formed by a cam mounted in idle on the motor shaft.

U.S. Pat. No. 3.824,921 to Alexander teaches a power press which is equipped with a progressive die for continuously working strip stock into perforated plates having embossed inscriptions and serial numbers, such as automobile license plates. The die includes a flat concentric assembly of relatively rotatable rings each of which has a circular series of consecutive digit embossing elements at the obverse side of the assembly. At the converse side of the ring assembly a back and forth swingable indexing arm cooperates with notches in the rings so as to rotate the rings stepwise in predetermined order and present the digit embossing elements thereof in successive serial number configurations.

U.S. Pat. No. 4,611,483 to Hadaway teaches a metal working press having a base, a die set located over the base, and coaxial primary and secondary rams movable towards and away from the base to drive the die set through a working stroke and return it to an open condition. The die set includes upper and lower die assemblies and the upper die assembly is connected to the primary ram in such a manner as to prevent axial separation but permit lateral movement of the die set relative to the ram whereby the die set can be moved into and out of the press. The upper die assembly includes two die members which are relatively movable in the axial direction of the ram and the extent of that relative movement is preset by a lost motion mechanism existing in the connection between the primary ram and the upper die assembly and also by engagement between opposed surfaces of the two rams. An adjustable stop fixes the open position of the die set by cooperation with the secondary ram and a locking mechanism is provided to releasably hold the die set in the open position during removal from and replacement in the press. The rams are mounted in a cylinder which is connected to the base through side plates and each side plate has two part-cylindrical surfaces each of which engages with a complementary surface of the base and cylinder respectively, and those part-cylindrical surfaces are formed about a common axis.

Other prior art inventions disclose various refinements regarding the support and illumination of license plates:

U.S. Pat. No. 5,029,053 to Solow teaches An illuminated license plate frame is provided with lights arranged in a cavity formed between first and second frame members. The first frame member is light transmitting and the second, outwardly facing frame member is opaque, so that the emitted light is indirectly transmitted through the light transmitting frame member to produce a soft glow illumination effect.

Still other prior art inventions teach various precious metal compositions which have use in the manufacture of jewelry. The following is an example of such a composition.

U.S. Pat. No. 5,372,779 to Reti teaches a white gold alloy composition consisting essentially of about 35 to 50 weight percent of gold, about 35 to 63 weight percent of silver, about 0.1 to 7 weight percent of a whitening component of zinc, germanium or both, and palladium in an amount of about 9 weight percent or less. The whitening component and the palladium are present in an amount sufficient to impart a white gold appearance and a liquidus temperature of no greater than about 1950° F. to the alloy, preferably between about 1700° F. and 1900° F., and more preferably less than about 1850° F. Thus, the preferred amount of palladium is about 2 to 5 weight percent and the preferred amount of the whitening component is about 0.5 to 6 weight percent.

Still other prior art inventions disclose refinements in the art of jewelry making. Exemplary of such prior art inventions is the following:

U.S. Pat. No. 3686734 to Labarte, et al teaches a method of making jewelry from precious metals, such as gold, platinum, etc., and their alloys, which comprises starting with a rectangular strip of wire mesh, (known in the trade as "milanese"), adding additional wire coils of progressively shorter length to opposite margins, placing the loosely woven mesh into a shaping press to progressively compress the mesh into a circular or oval shape, coating one face with molding wax, electroplating the other side with copper, annealing and scouring the first surface, hammering the surface to crush the wires into a denser mass while retaining its circular, or oval, shape, re-annealing and re-scouring the mesh, coating the hammered surface with wax, repeating the copper electroplating step on the back, placing the plated surface in contact with a die having the desired design, hammering the first face again while the coppered surface contacts the die and removing the copper by acid etching.

Still other prior art inventions disclose apparatus for continuously index feed work pieces to other apparatus, for further processing:

U.S. Pat. No. 5,526,668 to Futamura, et al teaches an index-feed machining system having such a construction that a plurality of machining units on the bodies of which cassettes incorporating a plurality of machining tools are detachably mounted are disposed at intervals at mP (m being a given positive integer, P being a work piece-feeding pitch) in the work piece-feeding direction, corresponding to a plurality of machining processes; the machining processes being sequentially performed by the machining units at the index-feed pitches of the work piece, in which a drive for driving the machining means are provided in the cassettes comprising any machining units.

However, none of the foregoing references either standing alone or in combination, teach a process for manufacturing a personalized license plate pendant or charm or the product of such a process.

SUMMARY OF THE INVENTION

License plates have been with the consuming public since at least the invention of the automobile. The history of license plates includes the production of them by prison inmates. This tradition continues to this day through the stamping die process on metal. Alpha numeric characters are portioned accordingly and then stamped onto a metal (typically now aluminum) blank to produce an exclusively unique alpha numeric combination on each license plate. The process applies pressure to both faces of the metal blank and thereby produces raised or embossed characters on the license plate. This process is commonly know as "punch on die."

Although personalized license plates for motor vehicles have become the vogue, in recent years, the instant invention is the first to provide a process and a product by its process which translates this idea into an element of jewelry.

Here as broadly outlined are the more important features of the invention in order that the detailed description thereof that follows may be better understood, and in order that the present contribution to the art may be better appreciated. There are additional features of the invention that will be described hereinafter and which form the subject matter of the appended claims. Those of ordinary skill in the art will appreciate that the conception upon which this disclosure is based may readily be utilized as a basis for the designing of other structures, methods and systems for carrying out the several purposes of the instant invention. It is important, therefore, that the claims be regarded as including such equivalent constructions insofar as they do not depart from the spirit and scope of the instant invention.

Further, the purpose of the instant abstract is to enable the U.S. Patent and Trademark office and the public generally, and especially the scientists, engineers and practitioners in the art who are not familiar with patent or legal terms or phraseology, to determine quickly from a cursor inspection of it, the technical disclosure of the patent application. The abstract is neither intended to define the invention of the instant patent application, which is measured by the claims, nor is it intended in any manner to be limiting as to the scope of the instant invention.

In light of the foregoing, it is therefore an object of the instant invention to provide a new and improved process and product of such a process which has all of the advantages of the prior art and none of its disadvantages.

It is another object of the instant invention to provide a new and improved process and article of jewelry produced by the process, which may be easily and efficiently manufactured and marketed.

It is another object of the instant invention to provide a new and improved product of jewelry which is of a pleasing and esthetic form.

It is another object of the instant invention to provide a new and improved product of jewelry which is of a pleasing and esthetic form and can be used or displayed on necklaces, bracelets, rings, earrings, and the like.

It is another object of the instant invention to provide a new and improved product of jewelry which is of a pleasing and esthetic form and can be used or displayed on necklaces, bracelets, rings, earrings, and the like, and is comprised of, or is plated with, at least one of the precious metals selected from the group of: gold, silver, platinum, palladium, vanadium and combinations thereof.

It is another object of the instant invention to provide product of jewelry which can be manufactured at less expensive cost with regard to at least labor, and which accordingly can be sold at an accordingly lower cost to members of the consuming public, thus promoting commerce.

It is a further object of the instant invention to provide a process for producing a personalized license plate pendant and the product of that process, which provides at least some of the advantages of the prior art schemes, while simultaneously eliminating at least some of the disadvantages of them.

It is a further object of the instant invention to provide a new and improved personalized license plate pendant which is particularly designed to be pleasing and esthetic to the consuming public.

It is a further object of the instant invention to provide a pleasing and esthetic article of precious metal license plate jewelry which can be distributed to, and sold at, jewelry counters in most national department stores, jewelry stores, catalog showrooms, kiosks, membership warehouses, television shopping networks, discount outlets, print publications, INTERNET customer and wholesaler outlets, and the like.

It is a further object of the instant invention to provide a pleasing and esthetic article of precious metal license plate jewelry which can be marketed in retail outlets either on counter or in showcase display areas.

It is a further object of the instant invention to provide a new and improved personalized license plate pendant which is far more unique and subject to customization that it can be marketed on a per order basis.

It is a further object of the instant invention to provide a new and improved personalized license plate pendant which requires little or no inventory.

It is a further object of the instant invention to provide a new and improved personalized license plate pendant which minimizes capital investment otherwise required by substantial inventories.

It is a further object of the instant invention to provide a new and improved personalized license plate pendant, unlike other personalized products does not require a custom price tag.

These together with other objects of the invention and the various features of novelty which characterize the invention, are pointed out with particularity in the claims appended to and forming a part of this disclosure. For a better understanding of the invention, its operating advantages and the specific objects attained by its uses, reference should be made to the accompanying drawings and descriptive matter in which the preferred embodiments of the invention are illustrated.

DETAILED DESCRIPTION OF THE INVENTION

Figure 1:
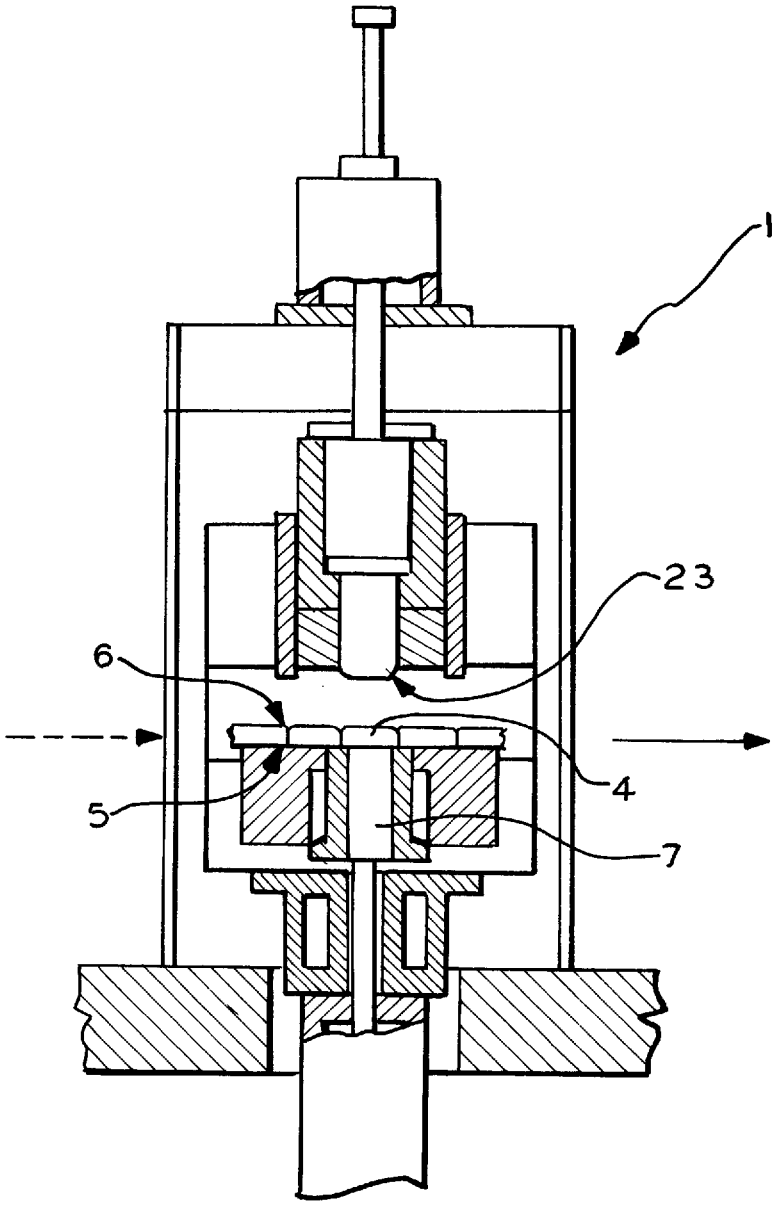
FIG. 1 shows the process of the instant invention and a product made thereby.

FIG. 1 shows the process of the instant invention. The first step of the process includes: providing a press (1) having at least one die (2) which forms the negative image of one face of a license plate of sufficiently small size to be used as an element of jewelry. Next, a generally planar blank (4) having an upper (5) and a lower surface (6) is provided. The blank (4) is comprised of a precious metal such as: gold, silver, platinum, palladium, vanadium or combinations of these metals. It can consist of solid precious metal or merely a plating of precious metal. The blank (4) which is from about 0.1 mm to about 2.00 mm, preferably 0.1 mm to about 1.00 mm, and most preferably about 0.10 mm to about 0.45 mm, is fed into the die set of the press, to shave the sides of excess precious metal resulting from the pressing process. Grooves are created to allow for continuous feed of the plate through the press. The process next includes: impressing the at least one die (2) on the blank (4) with the press (1) sufficient to emboss a positive image of the license plate on at least one surface. It should be noted here that the term "the press" as used herein may refer to a series of presses arranged in sequence. Optionally, the press of the invention also comprises at least one other die (7) which forms the negative image of the face opposite the one face of the license plate and is positioned in the press (1) opposite to the die (2), sufficient to produce at least one copy of the license plate when the (2) is caused to be pressed against the other die (7) within the press (1). Optionally, as the blank (4) continues through the dies (2) and (7) preferably up to three (3) holes (9) (see FIG. 2) are cut into the blank (4) in optional locations. Each hole is cut to accommodate a bail (10) (see FIG. 2). Optionally, the dies (2) and (7) are designed to provide an embossed framed border around the finished product (see FIG. 2). Still further optionally, a further die set may be provided to emboss the framed border separately, thereby retaining the option to provide the finished product without a framed border. After the optional hole cutting step, the processed blank is fed further through the press where it is die cut to its precise finished size. Optionally, the blank is then further passed through the press where the individual state designation is embossed on the blank in the appropriate position on the blank. The blank is then optionally fed through a further dies set wherein the preset personalized alpha, numeric and/or symbolic characters are embossed on it to produce the finished article. The article is then subjected to a inspection for quality control, wherein, i.e., it is checked for the correctness, positioning, embossing depth, and the like, of the personalized data. Optionally, a bail loop is then soldered into the pre-cut holes. This set may be effected by hand or further machine processing. A further option hand effected step may include: high polishing, diamond cutting, sandblasting, Florentine, and the like.

Figure 2:
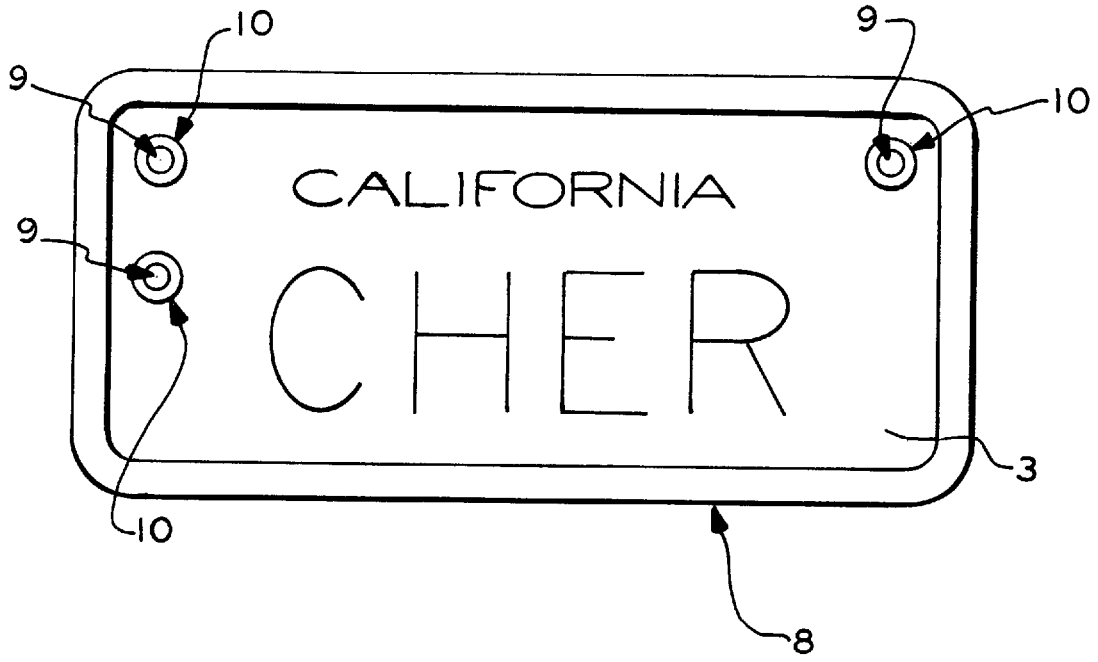
FIG. 2 shows the product by the process of the instant invention.

As shown in FIG. 2, the product (8) by the process comprises the finished element formed in the image of a miniature license plate blank, which has use as jewelry. Typically, the product (8) comprises a flat, rectangular plate of precious metal, weighing from about 0.1 grams to about 15.0 grams, and preferably from about 0.3 grams to about 12.0 grams, and most preferably from about 0.5 grams to about 10.0 grams. Thus, the dimensions of each finished product (8) will vary, depending on the weight of the initial rectangular plate blank and the dimensions of the dies (2) and (7) (see FIG. 1). Also, the finished product will preferably comprise holes (9) with soldered bails (10) on at least one side thereof.

The personalized indicia embossed upon the finished product (8) can comprise, but is not necessarily limited to: single names, multiple names, nick names, titles, phrases, symbols, school names, countries, sports, logos designs, clubs, organizations, names of games, animals, and the like, and any other indicia of substantially any other design and/or size permitted by the dimensions of the product (8). Examples of typeset styles of the instant invention preferably include, but are not necessarily limited to: Gothic, Old English, modern, script, and the like. The number if individual alpha or numeric characters which can be embossed on the finished product (8) will vary depending upon the typeset style chosen and the dimensions which have been selected for final product (8).

Although the invention has been described with reference to certain preferred embodiments, it will be appreciated that many variations and modifications may be made within the scope of the broad principles of the invention. Hence, it is intended that the preferred embodiments and all of such variations and modifications be included within the scope and spirit of the invention, as defined by the following claims.

I claim:

1. A process comprising:

providing a press having at least one die which forms the negative image of one face of a license plate of sufficiently small size to be used as an element of jewelry;

providing a generally planar blank having an upper and a lower surface, and comprised of a precious metal selected from the group consisting of: gold, silver, platinum, palladium, vanadium and combinations thereof;

impressing said at least one die on said blank with said press sufficient to emboss a positive image of said license plate on at least one surface;

cutting three holes in said blank; and, soldering a bail loop into at least one of said holes.

2. The process of claim 1 wherein said press comprises at least one other die which forms the negative image of the face opposite said one face of said license plate and is positioned in said press opposite to said first die sufficient to produce at least one copy of said license plate when said first die is caused to be pressed against said other die within said press.

3. The product by the process of claim 2.

4. The product by the process of claim 2, further comprising adding personalized indicia to said product.

5. A product by the process of:

providing a press having at least one die which forms the negative image of one face of a license plate of sufficiently small size to be used as an element of jewelry;

providing a generally planar blank having an upper and a lower surface, and comprised of a precious metal selected from the group consisting of gold, silver, platinum, palladium, vanadium and combinations thereof;

impressing said at least one die on said blank with said press sufficient to emboss a positive image of said license plate on at least one surface cutting three holes in said blank; and, soldering a bail loop into at least one of said holes.

6. The product by the process of claim 5, wherein said press comprises at least one other die which forms the negative image of the face opposite said one face of said license plate and is positioned in said press opposite to said at least one die, sufficient to produce at least one copy of said license plate when said at least one die is caused to be pressed against said at least one other die within said press.

7. The product by the process of claim 6, further comprising personalized indicia.

* * * * *